United States Patent [19]

Lott et al.

[11] 4,052,175

[45] Oct. 4, 1977

[54] AUTOMATIC SNAG GRINDER

[75] Inventors: George T. Lott; Harold J. Kiewert, both of Cincinnati, Ohio

[73] Assignee: Lott Tool Corporation, Cincinnati, Ohio

[21] Appl. No.: 682,496

[22] Filed: May 3, 1976

[51] Int. Cl.[2] ..... B24B 3/04; B24B 9/06

[52] U.S. Cl. ..... 51/96; 51/97 R; 51/215 E

[58] Field of Search ..... 51/97 R, 97 NC, 96, 51/95 WH, 118, 124, 234, 215 E, 215 M, 215 CP, 215 H

[56] References Cited

U.S. PATENT DOCUMENTS

| | | | |
|---|---|---|---|
| 2,425,234 | 8/1947 | Erwin | 51/96 |
| 3,425,169 | 2/1969 | Dunn | 51/118 |
| 3,707,809 | 1/1973 | Schnellman | 51/215 H |
| 3,800,476 | 4/1974 | Fallon | 51/118 |

*Primary Examiner*—James L. Jones, Jr.
*Assistant Examiner*—Nicholas P. Godici
*Attorney, Agent, or Firm*—Melville, Strasser, Foster & Hoffman

[57] ABSTRACT

An automatic snag grinder having conveyor means to feed a succession of parts to be ground into position before a ram. The ram pushes a part to be ground onto a tilting table whereafter the ram returns. The table tilts to about a 30° angle at which point a pivoted arm moves so as to clamp the part against a stop pad whereafter the table returns to its horizontal position. A main arm swings from a retracted position to one of about 30° so that it is properly positioned with respect to the clamped part, the main arm having a platen which will then be disposed immediately beneath the part and a centering mechanism which is then disposed immediately about the part. A ram for the main arm then fires so that the centering mechanism will clamp and center the part on the platen. Thereafter the main arm moves towards its retracted position and as it so moves it brings the part into contact with a rotating grinding wheel which effectively grinds off protruding gates and the like. Upon reaching its retracted position the main arm clamp is released and the ground part is ejected by gravity. In one arrangement of the invention, the platen on which the part is clamped by the centering mechanism rotates; as the rotating part moves into the grinding wheel the predetermined torque of the platen can be overcome by the resistance between the part and the grinding wheel acting thereon whereby the platen and part slow down to the predetermined torque load while grinding is achieved, whereafter the platen and part will speed up until the next area to be ground, on the same part, hits the grinding wheel whereby the part and platen are again slowed while further grinding is achieved. In a modification of the invention the platen for the part, rather than rotating continuously, may be indexed as desired.

16 Claims, 5 Drawing Figures

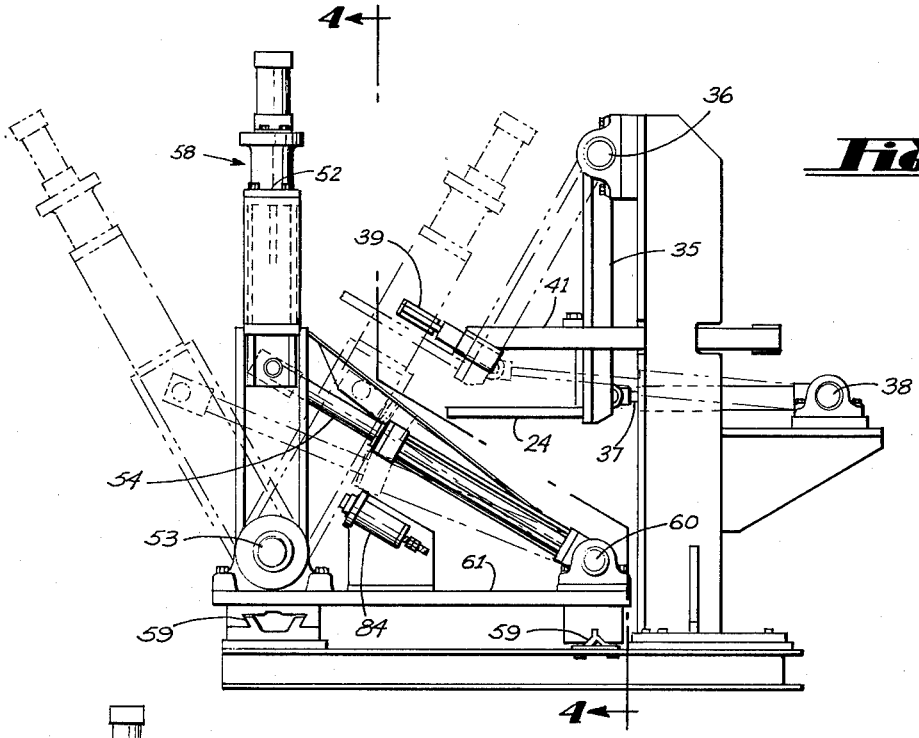
Fig. 3
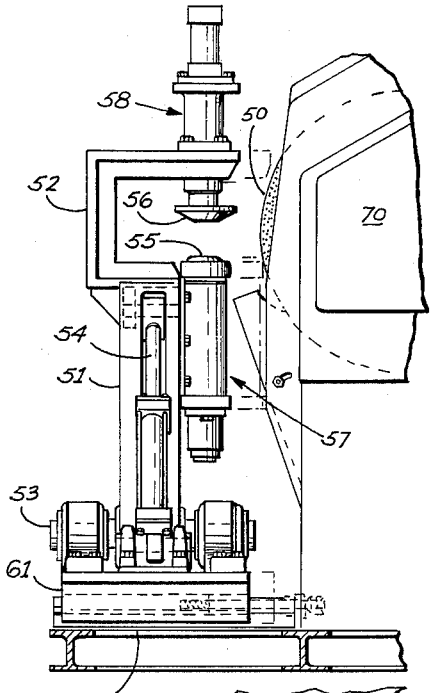
Fig. 4
Fig. 5
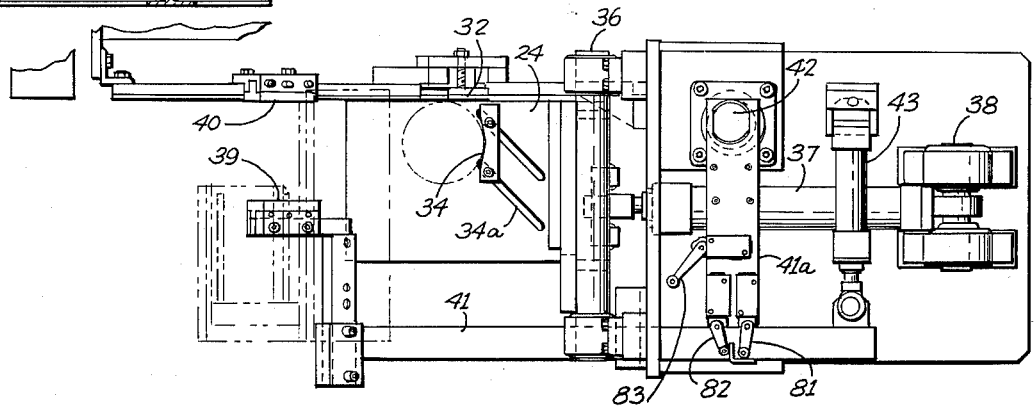

AUTOMATIC SNAG GRINDER

BACKGROUND OF THE INVENTION

1. Field of the Invention

The automatic snag grinder of this invention is particularly suited for the automatic snag grinding of both round and square castings in removing parting line fins and gates. It may be used, for example, to grind concentric power steering clutch plates and castings. It will accomodate either round or square castings from approximately 4½ inches to 12 inches or equivalent diameter and the castings may be from ½ inch to 6 inches thick. This particular automatic snag grinder, therefore, will satisfy a larger percentage of production snag grinding applications quite economically. When tooled to grind concentric power steering clutch plate castings, by way of example, the grinder may produce up to 600 pieces per hour.

2. Description of the Prior Art

No search of the U.S. patent art has been made in connection with this invention. It is known, however, that there are, and have been, many grinding devices in use in industry for a great number of years. Earlier snag grinding machines were usually especially designed for each application and were generally restricted to round castings.

SUMMARY OF THE INVENTION

The machine may incorporate a 30 inch diameter grinding wheel mounted on a precision spindle operating on preloaded Timken taper roller bearings and providing an average 9500 SFM for the grinding wheel. The spindle may slide mounted to provide incremental positioning of the wheel in relation to the casting to be ground so as to compensate for wheel wear as well as for depth of cut adjustment.

A ram shoves a casting into position on a suitable pivotable table and retracts. The table pivots upwardly and a clamp arm engages the O D of the casting and clamps it against a suitable pad whereafter the pivotable table retracts. The main arm, which carries a member to receive the casting and mechanism to clamp the casting on such member, swings from a position of about 30° to one side of the grinding wheel to a position of about 30° to the other side of the grinding wheel wherein the casting receiving member is immediately below and adjacent the casting. At this point a location of centering device fires and the casting is centered upon and clamped to the casting receiving member whereafter the clamp arm retracts. The main arm that swings back towards its original position and the casting is ground as it moves into contact with the grinding wheel when the ram is approximately vertical. After grinding the main arm continues to its original 30° position and the ground part is released and gravity ejected.

These are various settings on the clamp arm to accomodate different sized castings and the like. When round castings are ground, movement of the casting receiving member or turntable is continuous. This grinder, however, may be used for profile grinding by indexing the turntable rather than rotating it continuously.

A unique control device automatically positions the grinding wheel to compensate for wear. After initial set-up, the control advances the wheel in 0.001 inch increments at a rate in relation to the wheel diameter. This control may be adjusted for variations in wheel composition and it also provides for manual over-ride to increase the depth of cutting should additional stock removable be required.

The main or pendulm arm oscillates substantially in front of the grinding wheel to 30° either side of center and accepts the workpiece from the clamping or gripper arm assembly which presents the workpiece at the 30° elevation. The pendulum arm is equipped with a casting receiving member which may be a constant rotating platen, or an indexable platen, fixtured to accomodate the particular requirements for the workpiece to be treated. The clamping mechanism, mounted on the pendulum arm and situated above the platen, advances to locate and clamp the part in position with over 4000 pounds of force.

The rotary platen may be powered by a hydraulic motor with torque variable from 139 to 200 inch pounds. The rotating speed is also variable from 60 to 200 RPM with the average being at approximately 120 RPM.

Once the workpiece is located on the platen, either rotating or indexable as the case may be, the pendulum arm moves in rapid traverse toward the grinding wheel, feeds at a controlled slower rate across the face, and then traverses at the more rapid rate to the extreme starting point where the workpiece is released and deposited into a bin or onto a conveyor. Traverse and feed strokes of the pendulum arm as well as torque and rotational feed rate of the platen are adjustable.

The clamping or gripper arm assembly, equipped with polyurethane pads, semi-locates the workpiece before presenting it to the pendulum arm at the 30° elevation. The ram or shuttle devices on the machine accepts parts from plant conveyors or magazines and moves them by way of the pivotal table into the gripper arm assembly.

The wheel spindle may be powered by a 25 hp. AC drive motor with provisions for 40 hp. or more if needed. The machine is preferably hydraulically operated and electrically controlled with safety interlocks to prevent mishap. The control panel may be remote if the machine is to be isolated in an environmental enclosure. Preferably three modes of operation, manual, semi-automatic and automatic are provided to facililate set-up.

The machine may be completely guarded with outlets for connection to central dust collection systems and all bearing points are lubricated automatically by a positive pressure lubrication system. When fixtured for square parts, the pendulum cycles in front of the grinding wheel with the rotary platen indexing the workpiece 90° after each pass. The rotating or indexing platen and clamp are equipped with male and female centers to accommodate a family of sizes with only minor adjustment.

BRIEF DESCRIPTION OF THE DRAWINGS

FIG. 3 is a partial front elevation of the grinder as seen from the line 3—3 of FIG. 2.

FIG. 4 is a side elevation of a portion of the grinder as seen from the line 4—4 of FIG. 3 (see also the line 4–4 of FIG. 2).

FIG. 5 is an enlarged partial top view of the grinder of this invention.

DESCRIPTION OF THE PREFERRED EMBODIMENTS

Figure 1:
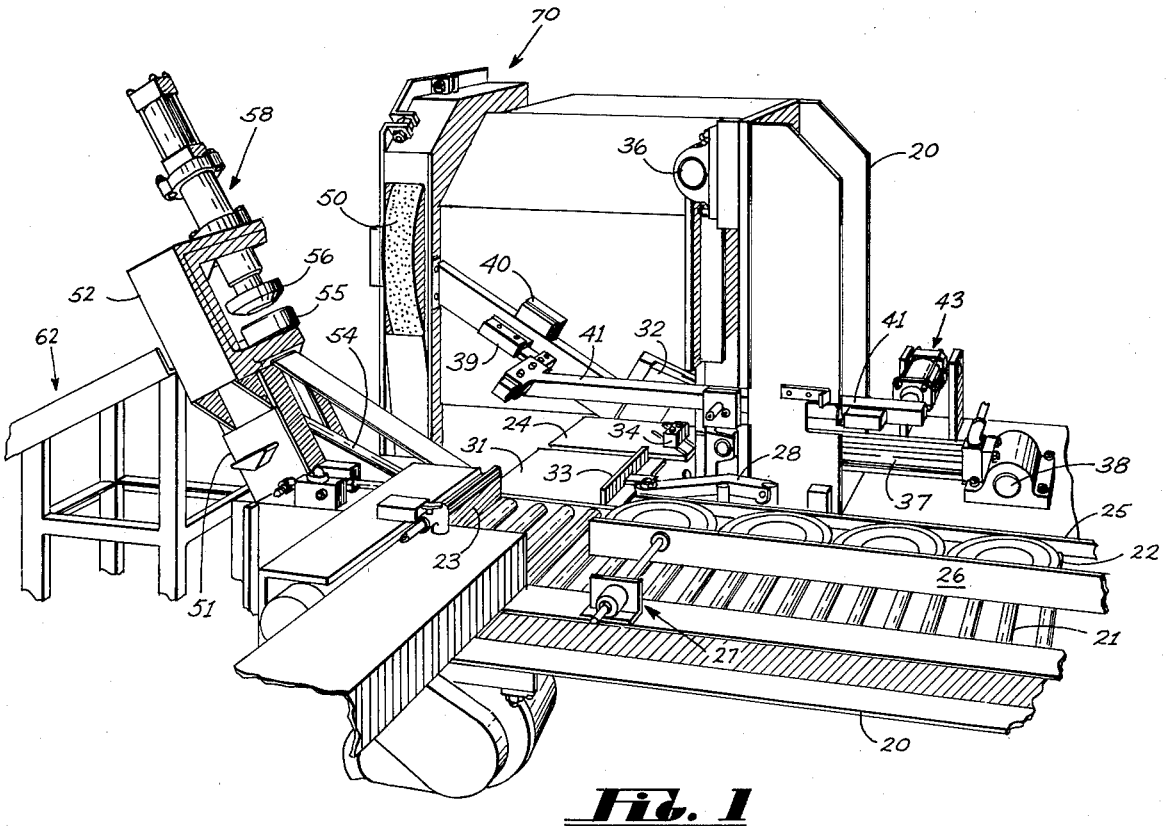
FIG. 1 is a partial perspective view of the automatic snag grinder of this invention.

Referring now first to FIG. 1 the automatic snag grinder of this invention includes suitable framework some of which is indicated at 20. Any one of a number of conventional conveyors is indicated at 21 for bringing a succession of workpieces 22 against a stop 23 in front of a tilting table 24. Guides 25 and 26 are adjustable as indicated at 27 to accommodate workpieces 22 of different sizes. A pivoted metering arm 28 regulates the flow of workpieces to the stop 23. At this point actuation of a ram 29 having a ram pad 30 (see also FIG. 2) will engage that workpiece which is against the stop 23 and move it across the stationary table 31 into position on the tilting table 24 against the stop 32. Adjustable positioning blocks 33 and 34 are provided to guide the workpieces 22 as they move across the stationary table 31 and tilting table 24 respectively.

The tilting table 24 is fixed to a pivot arm 35 connected to the framework 20 by a suitable table hinge 36. The tilting table 24 and its pivotal table arm 35 are actuated by the reciprocating table ram 37. This latter ram may also be pivotally mounted as indicated at 38 (see also FIG. 3). When a workpiece 22 has been located on the tilting table 24 and positioned by the stop 32 and block 34, the table ram 37 is actuated so as to move the table 24 upward and to the left, as viewed in FIG. 1, to bring it and the workpiece into position between a movable grabber clamp 39 and a stationary pad 40. The grabber clamp 39 is fastened on a grabber arm lever 41 which is pivoted at 42 (see also FIG. 5) and is controlled by a reciprocal grabber arm ram 43. The lever 41 has an intermediate linkage 41*a* which is connected between the lever 41 and pivot point 42. When the table ram 37 is actuated to bring the tilting table 24 to the dotted line position of FIG. 3, the pivoted table arm 35 swings about the table hinge and the table ram 37 moves about its pivot 38 are required, and a workpiece 22 is thus brought into position between the grabber clamp 39 and stationary pad 40, whereafter actuation of the grabber arm ram 43 will cause the levers 41, 41*a* to pivot about the pivot member 42 to move the clamp 39 towards the pad 40 whereby the clamp the workpiece 22 in position against such pad 40. At this point the table ram 37 retracts so as to bring the tilting table 24 to its horizontal, workpiece receiving position. The workpiece 22 now clamped between the members 39 and 40 is in position to be engaged by those members which will present it to the grinding wheel.

The main pendulum arm is generally indicated at 51 and includes an upper C-shaped section 52. The pendulum arm 51 is pivoted as indicated at 53 and is moved back and forth in front of the grinding wheel 50 by means of the pendulum arm ram generally indicated at 54. A platen 55 is located in the lower part of the C-shaped portion of the pendulum arm and a combined clamping - centering device 56 is located in the upper part of that C-shaped portion. Means generally indicated at 57 are provided for either rotating the platen 55, or indexing same, as desired. Means 58 control actuation of the centering-clamping member 56 towards the platen 55 so as to center and clamp a workpiece 22 thereon when these members 55 and 56 are brought into position below and above that workpiece which is clamped between the members 39 and 40 as will be described. The pendulum arm 51 and associated mechanisms are mounted on a suitable track 59 so that such arm and mechanisms can be moved towards and away from the grinding wheel 50 as may be required depending on the size and shape of the workpiece being operated upon. The pendulum arm ram 54 is pivotally connected at 60 to the carriage mechanism 61 which rides on the adjustable tracks 59.

The pendulum arm ram 54 operates to move the pendulum arm 51 from the dotted line, left-hand position to FIG. 3 through the full line vertical position at which the arm is directly in front of the grinding wheel 50, and to the dotted line right-hand position of FIG. 3 wherein the platen 55 will be disposed immediately beneath a workpiece 22 held between the clamp 39 and pad 40 while the centering-clamping member 56 will be disposed immediately above such clamped workpiece. At this latter position the means 58 will move the centering-clamping member 56 into engagement with the workpiece 22 and force it onto the platen 55. If the workpiece is to be rotated while grinding is achieved, the means 57 will be actuated to so rotate the platen 55. The grabber arm levers 41, 41*a* will move about their pivot so as to release the clamped workpiece 22 for engagement by the members 55 and 56 as just described. The pendulum arm 51 will then be moved from its dotted right-hand position of FIG. 3 to its dotted left-hand position in that FIGURE during which time it will, of course, pass the grinding wheel 50. During such pass the workpiece 22 which is clamped between the platen 55 and centering-clamping member 56 will engage the rotating grinding wheel 50 and any fins and gates on such workpiece will be ground off as determined by the setting of the various elements with respect to one another. Upon reaching the dotted line left-hand discharge position of FIG. 3, the means 57 and 58 will be actuated to cause the platen 55 and centering-clamping member 56 to release the workpiece 22 so that it will discharge therefrom by gravity onto a suitable table, conveyor or the like as generally indicated at 62.

Figure 2:
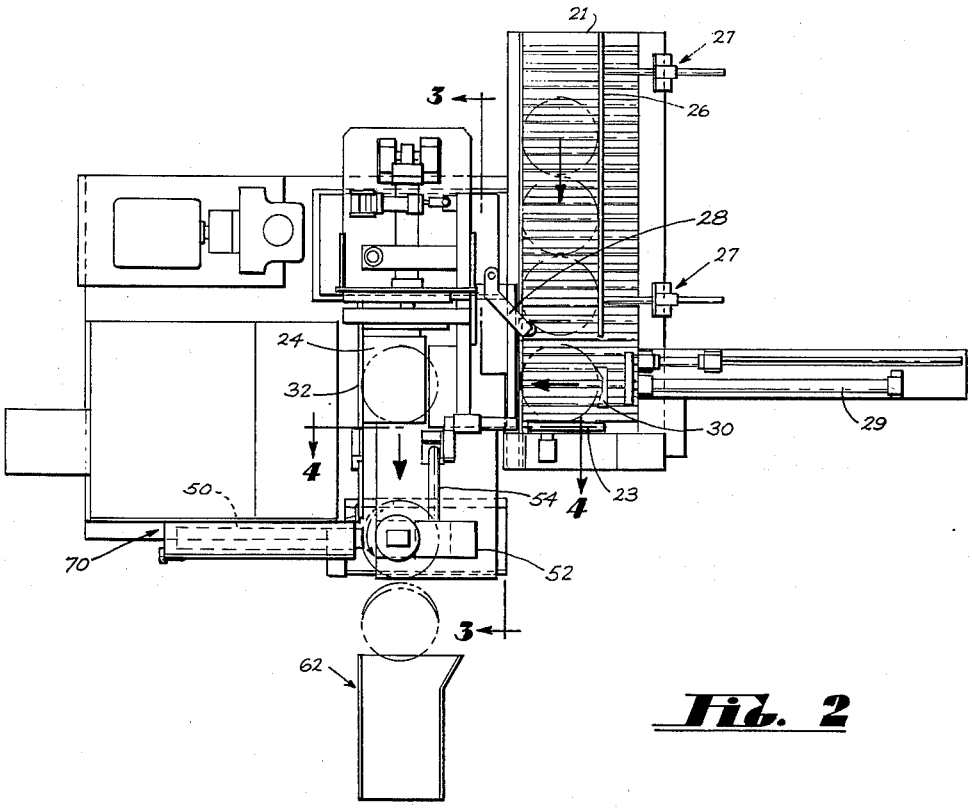
FIG. 2 is a top plan view of the grinder.

From the foregoing it will be seen that a succession of workpieces 22 are brought in on a conventional conveyor 21 as will be understood by those skilled in the art and, in accordance with the pivoted metering arm 28, one by one these pieces will be brought against the stop 23. A ram 29 will then be actuated to shove a workpiece to be ground onto the tilting table 24 as aided by the stationary bridging table 31 and guide 33 and positioning block 34; such workpiece 22 will engage the stop 32 whereafter the ram 29 will return to its workpiece receiving position as indicated in FIG. 2. The tilting table ram 37, pivoted at 38, will then be actuated to move the table 24 and workpiece 22 thereon into position between the grabber clamp 39 and stationary pad 40, the table arm 35 pivoting about its hinge 36 as the ram 37 is so actuated. The table is brought to about a 30° angle and at this point the horizontally pivoted levers 41, 41*a* are moved by the grabber arm ram 43 so as to move the grabber arm clamp 39 against the workpiece 22 so as to clamp it against the grabber pad 40, whereafter the table ram 37 is actuated to bring the table 24 to its normal horizontal workpiece receiving position. The pendulum arm ram 54 is then actuated to swing the main pendulum arm 51 from its retracted or discharge position as shown in dotted lines in FIG. 3 to a dotted line receiving position of about 30° so that the platen 55 and the centering-clamping member 56 are disposed below and above that workpiece 22 which is clamped between the members 39 and 40; the C-shaped portion 52 of the pendulum arm 51 permits these members to be so brought into such position prior to the time the levers **41, 41*a* are actuated to release the workpiece 22. The ram means 58 then fires so as to clamp and center the workpiece 22 on the platen 55 of the levers 41, 41*a* withdraw the clamp 39. The pendulum arm ram 54 then is further actated to move the pendulum arm 51 to bring the workpiece into contact with the grinding wheel 50. After grinding of the workpiece is completed as the pendulum arm 51 passes on by the grinding wheel 50, the pendulum arm will reach its discharge position and the means 58 will be actuated to release the workpiece from between the members 55 and 56 so that it may eject by gravity onto the table or conveyor means 62.**

In one arrangement of the invention the power means (not shown in detail) for the grinding wheel 50 and the means 57, 58 for the platen 55 and member 56 are so related to one another that as the rotating workpiece 22 moves into the grinding wheel 50 the torgue of the platen means 57 is overcome by the resistance between the workpiece 22 and grinding wheel 50 whereby the platen 55 and workpiece 22 slow down to a preset torgue load while grinding is achieved, whereafter the platen 55 and workpiece 22 will speed up until the next protuberance on the workpiece is brought into contact with the grinding wheel whereby the platen 55 and workpiece 22 are again slowed while further grinding on this additional protuberance is achieved.

It will be understood by those skilled in the art that the mechanism 50 may be modified so as to impart an indexing action to the platen 55 instead of a constantly rotating action as has been described. Such indexing of the platen 55 by the means 57 enables workpieces of other than round or circular shape to be ground.

The motor and spindle means for the grinding wheel 50 are generally indicated at 70 and, although not shown in detail, they are such as to include a precision spindle operating on preloaded Timken taper roller bearings so as to provide an average 9500 SFM for the grinding wheel 50, preferably of 30 inch diameter, all as will be understood by those skilled in the art. The spindle (not shown) is slide mounted to provide incremental positioning of the grinding wheel 50 in relation to the workpiece 22 to compensate for wheel wear as well as depth of cut adjustment.

An important part of the invention is the relationship between the means 57 for rotating the platen 55 and the power means 70 for the grinding wheel 50. Preferably the means 57 comprises a hydraulic motor which is capable of stalling out when high torque conditions prevail while the grinding wheel 50 continues to rotate. When torque conditions decrease as will be occasioned by grinding proceeds, the hydraulic means 57 will automatically resume and the platen 55 will continue its rotation so that other portions of the workpiece 22 thereon will be subjected to grinding. The hydraulic motor means 57 for the rotary platen 55 is preferably provided with a torque variable from 139 to 200 inch pounds while the rotating speed is also preferably variable from 60 to 200 RPM with the average being at approximately 120 RPM.

Also of importance, particularly with respect to the platen 55 and hydraulic power means 57 just described, is the centering-clamping element 56 and the power means 58 for actuating same. The pendulum arm 51, 52 oscillates sequentially in front of the grinding wheel 50 to 30° either side of center and accepts the wrokpiece 22 from the gripper arm assembly 39–42 which presents the workpiece at the 30 elevation. The centering-clamping mechanism 56, 58, situated above the platen 55, advances to locate and clamp the part in position with over 4000 pounds of force.

As indicated, the combination of the centering-clamping mechanism 56, 58 and the variable torque control through the hydraulic motor means 57 for the platen 55, whereby the workpiece 22 may be securely and positively located on the platen 55 with such force that the hydraulic motor means 57 may stall if necessary while grinding proceeds, and whereby the hydraulic motor means 57 may resume rotation of the platen 55 when the torque decreases, is quite important.

Once the workpiece 22 is located on the platen 55, the pendulum arm 51, 52 moves in rapid traverse toward the grinding wheel 50, feeds across the face of such wheel at a reduced and controlled rate; and traverses again in rapid rate to its discharge position where the workpiece is released and deposited onto a discharge table or conveyor 62. Traverse and feed strokes as well as feed rate are adjustable as will be understood by those skilled in the art. It will also be understood that means (not shown in detail) may be utilized for positioning the grinding wheel 50 so as to compensate for wheel wear. After initial set up, for example, controls included in the mechanism 70 may advance the grinding wheel 50 in 0.001 inch increments at a rate in relation to the wheel diameter as will be understood by those skilled in the art. The control may be adjusted for variations in wheel composition and may also include provision for manual over ride to increase the depth of cut should additional stock removal be required.

More specifically the mechanism 70 includes a 25 hp. A C drive motor with provisions for 40 hp. or more if needed, for the grinding wheel spindle.

Preferably the workpiece feed ram 29, tilting table ram 37, workpiece grabber ram 43 and pendulum arm ram 54, along with the motor means 57 and centering-clamping means 56, 58, are all hydraulically operated and electrically controlled with safety interlocks to prevent mishap, all as will be understood by those skilled in the art. The control panel may be remote from the automatic snag grinder proper if it is to be isolated in an environmental enclosure. Three modes of operation, manual, semi-automatic and automatic may be provided to facilitate set-up.

The shuttle device 29, 30 accepts workpieces 22 from plant conveyors or magazines 21 and initially presents the workpiece in proper position on the tilting table 24 as guided in part by the stop 32 and positioning block 34. The gripper arm assembly **41, 41*a*, preferably equipped with polyurethane pads 39 and 40, semi-locates the workpiece 22 before presenting it to the pendulum arm 51, 52 and the platen 55 and centering-clamping element 56 at the 30° elevation. Final centering is accomplished by actuation of the power means 58 whereafter, in that embodiment wherein the platen is to be rotated, the power means 57 is actuated and the pendulum arm ram 54 is then actuated to bring the workpiece to the rotating grinding wheel 50. When grinding is completed and the pendulum arm 51, 52 has reached its discharge position, the power means 58 is deactuated and the workpiece discharged by gravity to the discharge station 62.**

It is believed that the foregoing constitutes a full and complete disclosure of the invention. It will be apparent, however, to those skilled in the art that modifications may be made in this automatic snag grinder without departing from the scope and spirit of the invention underlying same. It is to be further understood that while the invention has been described in terms of certain perpendicular structures and arrangements, such structures and arrangements are not to be considered as a limitation on the invention except insofar as they are specifically included in the subjoined claims.

In connection with the hydraulically operated rams and related power means therefor, and the associated electrical controls, and by way of example only, note the use of sensors 81, 82 and 83 (FIG. 5) and the limit switch 84 (FIG. 3) to properly sequence the operation of these rams and the like. Another detail is depicted in FIG. 5 wherein the positioning block 34 is shown as being adjustably, slidably mounted in slots 34*a* provided in the table 24. These and other details of construction will be apparent to, and understood by, those skilled in the art from a reading of these specifications in connection with an examination of the accompanying drawings.

The embodiment of the invention in which an exclusive property or privilege is claimed as defined as follows:

1. An automatic snag grinder comprising a grinding wheel, first power means for actuating said grinding wheel, a platen to receive a workpiece thereon, centering-clamping means to hold said workpiece on said platen, second power means for rotating said platen at a selected speed and selected rotational torque, and positioning means to move said workpiece into grinding contact with said grinding wheel while said platen is rotating on a center line approximately 90° to the axis of the grinding wheel, the relationship among said first power means, said centering-clamping means and said second power means being such that said platen will slow down to a predetermined torque load while said workpiece is clamped on said platen in contact with said grinding wheel and while said grinding wheel remains operative, said second power means returning in said platen to its selected speed of rotation when said workpiece moves out of substantial contact with said grinding wheel.

2. The grinder of claim 1 in which said positioning means comprises a pivoted pendulum arm which swings back and forth sequentially across the working face of said grinding wheel to either side thereof, said platen and said centering-clamping means being mounted on said pendulum arm, and third power means for actuating said pendulum arm, said third power means being arranged to move said pendulum arm at a fast rate to position said platen to receive a workpiece thereon, then at the fast rate to move said workpiece into grinding contact with said grinding wheel, then at a slower rate while said workpiece is moved across said grinding wheel during grinding of said workpiece, then at the fast rate to a discharge position for the ground workpiece after said workpiece is moved out of contact with said grinding wheel, and then at the fast rate to pick up another workpiece, whereafter the sequence is repeated.

3. The grinder of claim 2 including a normally horizontal tiltable table, a fixed stop adjacent to said table, reciprocating means to move a workpiece onto said tiltable table when horizontal and against said fixed stop, a positioning block on said table for said workpiece, table actuating means to swing said table upwards toward said grinding wheel, an upper stop, a movable clamp opposite said upper stop, said table in its upward position presenting said workpiece between said upper stop and said clamp, means to actuate said clamp so as to clamp said workpiece against said upper stop, said clamped workpiece being then in position to be engaged by said platen and said centering-clamping means when said table returns to its horizontal position and when said pendulum arm is at one side of said grinding wheel.

4. The grinder of claim 3 including a discharge station at the other side of said grinding wheel, grinding of said workpiece occuring when said pendulum arm oscillates from said one side to said other side with a said workpiece clamped on said platen by said centering-clamping means, and means to release said centering-clamping means at said discharge station.

5. An automatic snag grinder comprising a grinding wheel, first power means to rotate said grinding wheel, a pivoted pendulum arm to swing back and forth in front of said grinding wheel from one side thereof to the other side thereof, second power means to swing said pendulum arm at two different and controlled rates, a platen on said pendulum arm to receive a workpiece to be ground by said grinding wheel, centerining-clamping means on said pendulum arm to clamp and center a workpiece on said platen, third power means to actuate said centering-clamping means and positioning means to place a workpiece on said platen, whereby when all of said first, second and third power means are actuated a workpiece will be clamped on said platen and moved into grinding engagement with said grinding wheel, said second power means being arranged to swing said pendulum arm at a fast rate to position said platen to receive a workpiece thereon, then at the fast rate to move said workpiece into grinding contact with said grinding wheel, then at a slower rate while said workpiece is moved across said grinding wheel during grinding of said workpiece, then at the fast rate to a discharge position for the ground workpiece after said workpiece is moved out of contact with said grinding wheel, and then at the fast rate to pick up another workpiece, whereafter the sequence is repeated.

6. The grinder of claim 5 including a fourth power means for moving said platen.

7. The grinder of claim 6 in which said fourth power means indexes said platen when said workpiece is free of said grinding wheel.

8. The grinder of claim 6 in which said fourth power means rotates said platen at a preselected speed and torque when said workpiece is free of grinding engagement with said grinding wheel, the relationship among all of said power means being such that when said workpiece is moved into grinding engagement with said grinding wheel said platen will slow down to a selected torque load while grinding continues and said platen will return to said preselected speed when grinding is completed.

9. The grinder of claim 8 in which said positioning means includes a normally horizontally disposed tiltable table, a reciprocating ram to engage a workpiece to move same onto said table while horizontally disposed, fifth power means to actuate said ram, sixth power means to tilt said table, and a positioning block on said table against which said workpiece rests, actuation of said sixth power means to tilt said table bringing the said workpiece thereon to a position to be received between said platen and said centering-clamping means.

10. The grinder of claim 9 including a stationary pad disposed above said horizontally disposed table and towards said grinding wheel, a pivoted grabber clamp spaced from and opposite said pad, said workpiece when on said table in its tilted position being disposed between said pad and said grabber clamp, and seventh power means to move said grabber clamp so as to clamp said workpiece between said grabber clamp and said pad, whereafter said sixth power means returns said table to its horizontal position while leaving said workpiece in position to be engaged by said platen and said centering-clamping means.

11. The grinder of claim 10 including conveyor means to bring a succession of workpieces in position to be engaged by said ram and moved onto said table, all of said positioning means being located on said other side of said grinding wheel, and a discharge station on said one side of said grinding wheel, grinding of said workpiece taking place when said pendulum arm moves from said other side to said one side with the said workpiece clamped on said rotating platen by said centering-clamping means.

12. An automatic snag grinder comprising: conveyor means to bring a succession of workpieces against a first stop; a reciprocating ram to move a said workpiece from said first stop onto a tiltable table and against a second stop; a third stop located above and to one side of said tiltable table; means to move said tiltable table towards said third stop so as to bring a said workpiece thereon opposite said third stop at an angle of about 30° with the horizontal; a grabber clamp movable to clamp said workpiece against said third stop whereafter said table is moved away from said third stop; a rotating grinding wheel spaced from said third stop; an oscillating pendulum arm movable 30° to either side of said grinding wheel; a rotatable platen and a centering-clamping means on said pendulum arm positioned so as to receive a said workpiece therebetween from against said third stop and means to actuate said centering-clamping means to clamp said workpiece on said platen whereafter said grabber clamp releases said workpiece; a discharge station for workpieces that have been ground; said grinding wheel being located between said third stop and said discharge station; and means to move said pendulum arm from said third stop to said discharge station, grinding of said workpiece being achieved as said pendulum arm is so moved.

13. The grinder of claim 12 including means to periodically index said rotatable platen before grinding said workpiece.

14. The grinder of claim 12 including means to rotate said platen at a selected speed.

15. The grinder of claim 14 in which said last mentioned means slows down rotation of said platen during grinding of said workpiece.

16. The grinder of claim 15 including a C-shaped member on said pendulum arm and opening towards said grinding wheel, said platen and said centering-clamping means being mounted on the arms of said C, said C-shaped member being large enough to clear said grabber clamp and when said pendulum arm is so moved as to pick up a workpiece from against said third stop and to permit said grabber arm to release said workpiece when said centering-clamping means clamps said workpiece on said platen.

* * * * *

UNITED STATES PATENT OFFICE

CERTIFICATE OF CORRECTION

Patent No. 4,052,175 Dated October 4, 1977

Inventor(s) GEORGE T. LOTT and HAROLD J. KIEWERT

It is certified that error appears in the above-identified patent and that said Letters Patent are hereby corrected as shown below:

Column 1, line 34, after "may" insert be
Column 1, line 48, cancel [location of] and insert locating.
Column 1, line 51, cancel [that] and insert then
Column 1, line 57, cancel [These] and insert There
Column 3, line 39, cancel [are] and insert as
Column 3, line 44, cancel [the] and insert to
Column 4, line 8, cancel [to] and insert of
Column 5, line 4, cancel [of] and insert as
Column 5, line 52, cancel [by] and insert as
Column 5, line 68, after "30" insert the degree sign ° so that the notation appears as 30°
Column 7, line 3 cancel [perpendicular] and insert particular
Column 7, line 21 cancel [as] and insert are
Column 7, line 38 cancel [in]
Column 10, line 26 cancel [and]

Signed and Sealed this

Seventh Day of February 1978

[SEAL]

*Attest:*

RUTH C. MASON
*Attesting Officer*

LUTRELLE F. PARKER
*Acting Commissioner of Patents and Trademarks*